United States Patent [19]

Satterfield

[11] Patent Number: 4,815,148

[45] Date of Patent: Mar. 28, 1989

[54] SIZE ADJUSTABLE HAT

[76] Inventor: Roy E. Satterfield, 309 Oak Park Dr., Knoxville, Tenn. 37918

[21] Appl. No.: 56,399

[22] Filed: May 29, 1987

[51] Int. Cl.[4] ..... H42B 1/22

[52] U.S. Cl. ..... 2/197; 2/DIG. 6

[58] Field of Search ..... 2/183, 197, 181, 237, 2/195

[56] References Cited

U.S. PATENT DOCUMENTS

| | | | |
|---|---|---|---|
| 2,775,769 | 1/1957 | Henschel | 2/197 |
| 3,737,918 | 6/1973 | Henschel et al. | 2/197 |
| 4,011,600 | 3/1977 | Malk | 2/183 |
| 4,023,212 | 5/1977 | Huffman | 2/197 |
| 4,101,981 | 7/1978 | Boden | 2/182.6 |

FOREIGN PATENT DOCUMENTS

| | | |
|---|---|---|
| 1259571 | 3/1961 | France . |
| 1400477 | 4/1965 | France . |
| 1273740 | 5/1972 | France . |
| 1019556 | 2/1966 | United Kingdom . |
| 1113788 | 5/1968 | United Kingdom . |

*Primary Examiner*—Henry S. Jaudon

*Attorney, Agent, or Firm*—Luedeka, Hodges & Neely

[57] ABSTRACT

Disclosed is a size adjustable hat including a crown having an opening for receiving the head of the wearer and a crown margin at the lower periphery of the crown. The hat further includes a sweatband attached at the inside of the crown margin with the seatband extending along the inside of said crown. A slit extends upwardly into the crown margin with a portion of the crown margin adjacent the slit forming a flap which overlaps a portion of the crown margin on the opposite side of the slit. The sweatband is also divided adjacent to the slit to form overlapping ends and has a region adjacent the flap which is free to be downturned to serve as an extension of the crown margin. The hat further includes attachment means for attaching the overlapped ends of the seatband in a plurality of overlapped positions. By folding the sweatband downwardly adjacent the flap and detaching and positioning the overlapped ends at a desired overlapped position, the diameter of the sweatband and the amount of overlap of the flap in the crown margin is adjusted to change the size of the hat.

7 Claims, 1 Drawing Sheet

SIZE ADJUSTABLE HAT

The present invention relates to hats and more particularly relates to size adjustable hats.

In order to accommodate the various head sizes of hat wearers, hats must either be "sized," i.e., provided in a variety of different sizes, or must include a size adjustment mechanism. Generally, sized hats are limited to more expensive, high quality hats due to the high cost of manufacturing hats in a number of sizes and the cost of providing an inventory of such hats in all sizes. Less expensive hats are usually provided with a hat size adjustment system which enables the wearer to adjust the hat to his head size.

For "baseball cap" style hats, a very common hat size adjustment system includes a large gap at the rear of the hat, usually of semi-circular shape, so that the diameter of the sweatband and lower portions of the crown can be increased or decreased. Plastic straps span the gap with one strap having a plurality of holes and the other strap having a plurality of studs for engaging the holes. The studs and holes enable the straps to be connected at a number of positions to adjust the size of the hat. While this system provides for size adjustment, the plastic straps are generally uncomfortable for the wearer and can chafe the wearer's head. Moreover, the large, semi-circular gap in the rear of the hat provides no protection from the sun and cold weather since the wearer's head is entirely exposed in that area.

Various other hats with size adjustment systems have been developed but most have not gained wide acceptance since they are complicated and difficult to manufacture or detract from the appearance of the hat.

Accordingly, it is an object of the present invention to provide a hat having a size adjustment feature which is attractive in appearance and which provides comfort and ease of adjustment for the wearer. Another object is to provide an improved size adjustable hat which can be manufactured easily. A more particular object is to provide an improved size-adjustable hat of the baseball cap style.

Other objects and advantages of the invention will be better understood from the following detailed description of a preferred embodiment and accompanying drawings in which.

Generally, a hat according to the present invention includes a crown having an opening for receiving the head of the wearer and having a marginal edge and crown margin adjacent the marginal edge at the lower periphery of the crown. The hat further includes a sweatband attached at the inside of the crown margin so that the sweatband extends along the inside of the crown. A slit extends from the marginal edge and into the crown margin with a portion of the crown margin adjacent the slit forming a flap which overlaps a portion of the crown margin on the opposite side of the slit. The sweatband is also divided adjacent to the slit to terminate at a flap sweatband end adjacent the flap and an opposite sweatband end on the opposite side of the slit from the flap with the flap sweatband end overlapping the opposite sweatband end. The sweatband has a down-turnable region adjacent the flap sweatband end which is free to be downturned to serve as an extension of the crown margin. The hat further includes attachment means for attaching the overlapped portions of the sweatband in a plurality of overlapped positions. By folding the sweatband downwardly adjacent the flap and detaching the positioning the overlapped ends at a desired overlapped position, the diameter of the sweatband and the amount of overlap of the flap in the crown margin is adjusted to change the size of the hat.

In a preferred form of the invention, the flap is dimensioned and configured so that the size of the opening for the head of the wearer can be enlarged or decreased through a normal range of head sizes with the flap continuing to overlap the crown margin on the opposite side of the slit so that no gap is formed at the rear of the hat. It is particularly advantageous to employ hook and loop fabric tape to attach the overlaped ends of the sweatband. Also in accordance with the invention, an improved size adjustable baseball cap style hat is provided.

Figure 1:
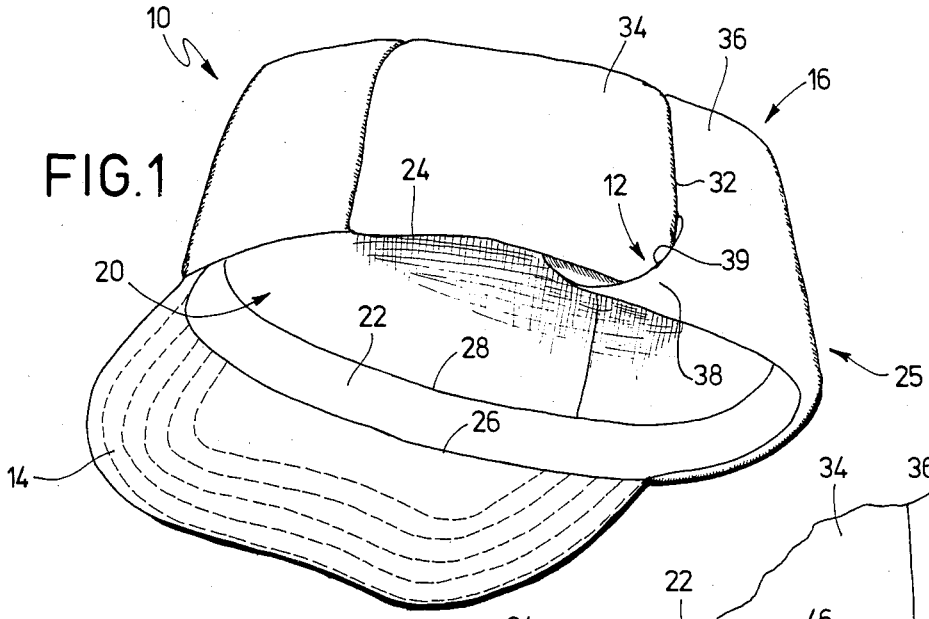
FIG. 1 is a rear perspective view of a size adjustable hat in accordance with a preferred form of the invention.

Referring now to the drawings in which like reference characters designate like or corresponding parts throughout the several views, FIG. 1 shows a preferred form of a hat 10 including a hat size adjustment feature 12 in accordance with the present invention. The hat 10 depicted is a baseball cap style hat which has a crescent-shaped visor 14 at the front of the hat in a slightly arched configuration attached to a crown 16. The visor 14 is suitably fabricated from a relatively stiff material such as cardboard or plastic with a fabric covering. The crown 16 has a somewhat hemispherical shape with a flattened upper area and is constructed from a number of fabric panels interconnected such as by sewing.

Referring still to FIG. 1, the crown 16 provides an opening 20 for receiving the head of the wearer. In this written description of the invention, the lower periphery of the crown 16 is referred to as a crown margin 25. A sweatband 22 is preferably provided by a strip of fabric attached to the inside of the crown margin 25 adjacent to a marginal edge 24 at the bottom of the crown 16. As will be explained in detail hereinafter, the size adjustment feature 12 is used to adjust the size of the opening 20 by adjusting the size of the crown margin 25 and the diameter of the sweatband 22.

Referring now to FIGS. 2–5, it is seen that the rear portion of the sweatband 22 can be folded downwardly to form a downturned region and thus serve as an extension of the crown margin 25 in this region. As shown, this is accomplished by attaching a lower edge 26 of the sweatband 22 such as by sewing to the crown 16 at or closely adjacent to the marginal edge 24 while leaving an upper edge 28 of the sweatband unattached. As will become apparent hereinafter, it is preferable for sweatband 22 on either side of the adjustment feature 12 to be free to be downturned but it is not necessary for the entire upper edge 28 to be unattached from the crown along the entire circumference of the sweatband.

Figure 3:
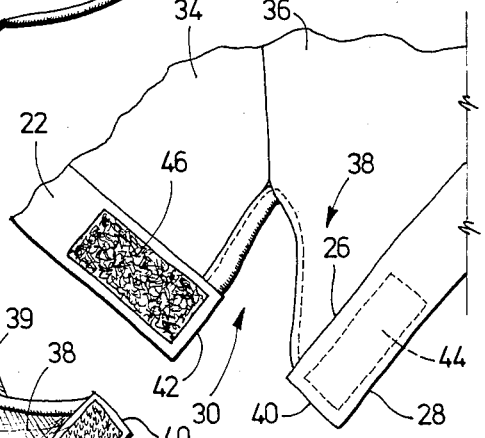
FIG. 3 is an enlarged partial rear view of the hat of FIG. 1 with the adjustment feature shown disengaged.
Figure 2:
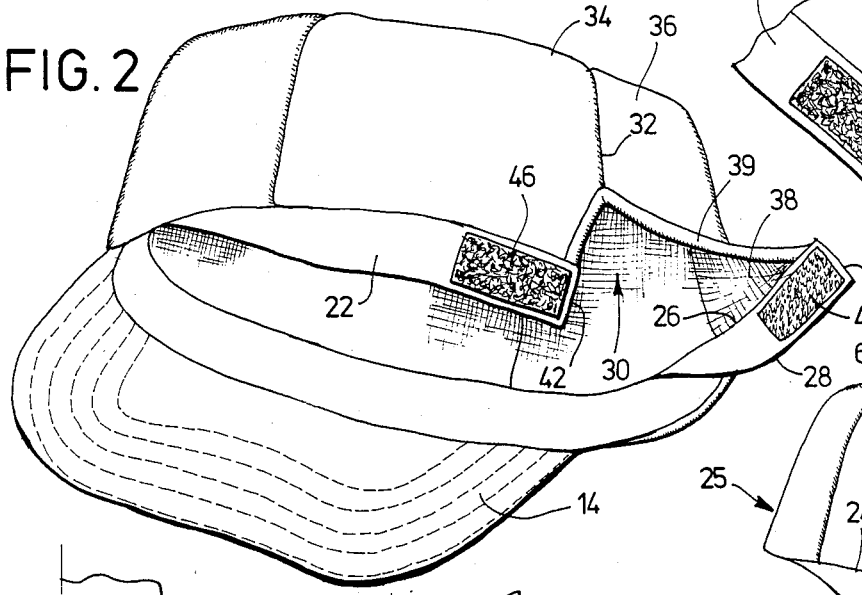
FIG. 2 is a similar view of the hat of FIG. 1 with the size adjustment feature of the hat shown in a disengaged configuration.

In the hat 10 illustrated, a slit 30 is located in a rear portion of the hat 10 as most clearly shown in FIGURES 2 and 3. The slit 30 is preferably provided at a seamline between fabric panels such as seamline 32 where the left and right rear fabric panels, 34 and 36 respectfully, are interconnected in the baseball style hat 10 depicted. As shown, the slit extends from the marginal edge 24 into the crown margin 25 by distance sufficient for the lower portions of the fabric panels 34 and 36 to be moved toward and away from one another to change the diameter of the crown margin. A slit length of from about 2 to about 3 inches is preferably employed and hems in the fabric adjacent the slit or appropriate binding are included to prevent the fabric from unraveling at the slit.

As is also shown in FIGS. 2 and 3, a fabric flap 38 is provided adjacent the slit 30 which overlaps a portion of the crown margin on the opposite side of the slit 30. The size and shape of the fabric flap 38 is such that it continues to provide an overlap when position of the fabric panels in the crown margin 25 and thus the size of the opening 20 are adjusted through a normal range of head sizes. The fabric flap 38 is most suitably provided by an extension of one of the rear fabric panels and most preferably has an upper edge 39 which extends from the upper most point of the slit 30 diagonally downwardly to a lower edge of the flap which is an extension of the marginal edge 24. If desired, the upper edge can be slightly curved as shown in FIG. 1. In the hat depicted in the drawings, the right rear panel 36 provides the flap 38 but it will of course be understood that the left rear fabric panel 38 can be similarly extended to form the flap 38 which would then overlap a portion of the right fabric panel 36.

As shown in FIGS. 2–5, the slit 30 also divides the sweatband 22. The sweatband 22 extends along the flap 28 and preferably terminates at flap sweatband end 40 at the furthermost portion of the fabric flap 38. On the other side of the slit 30, an opposite sweatband end 42 preferably terminates at the slit 30 in alignment with the edge of the left fabric panel 34. When the hat is in configuration to be worn as in FIGS. 1 and 7, the flap sweatband end 40 overlaps the opposite sweatband end 42. The amount of overlap of the ends 40 and 42 is sufficient for the relative position of the ends to be changed to adjust the hat through a normal range of head sides. A maximum overlap of between 2–4 inches is preferably provided. Hook and loop fabric tapes such as the hook and loop fabric tape sold under the trademark VELCRO are secured to the sweatband 22 on either side of the slit 30 such as by sewing and are used to attach the overlapped ends. As shown for the preferred embodiment, the hook tape 44 is attached to the inside of the flap sweatband end 40 and the loop tape 46 is attached to the outside of the left terminal sweatband end 42. As will become more apparent hereinafter, this arrangement is preferred since the loop tape 46 will face the wearer's head when that hat 10 is worn instead of the potentially more chafing hook tape 44.

Figure 4:
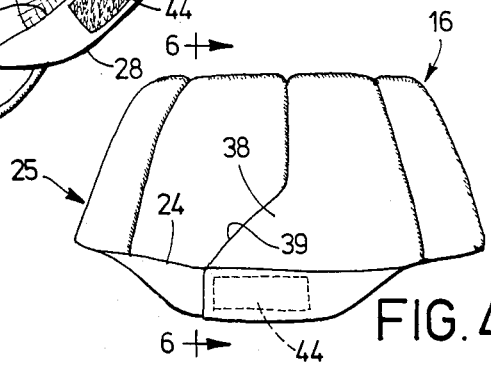
FIG. 4 is a rear elevational view of the hat of FIG. 1 showing the adjustment feature as used to adjust the hat to a smaller size.
Figure 5:
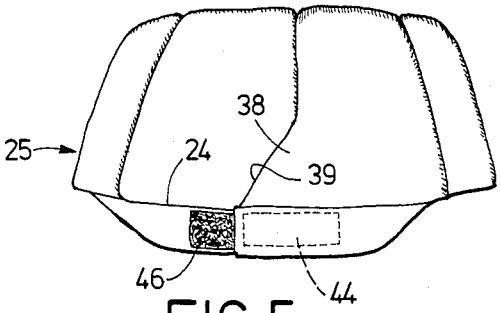
FIG. 5 is a similar view of the hat of FIG. 1 showing the adjustment feature being used to adjust the hat to a larger size.
Figure 6:
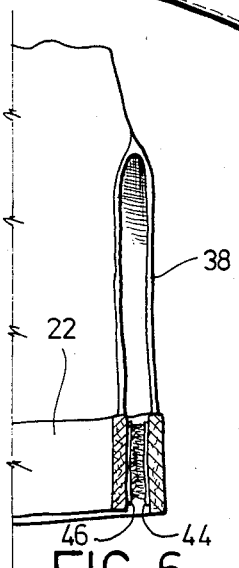
FIG. 6 is a partial cross-sectional view taken along line 6—6 of the hat as depicted in FIG. 4.
Figure 7:
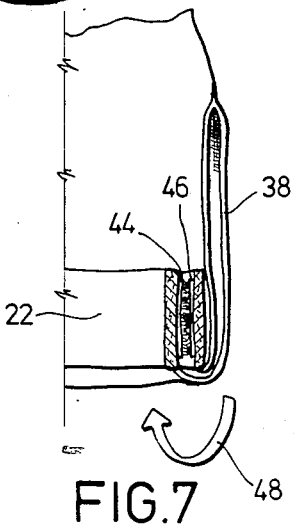
FIG. 7 is a view similar to FIG. 6 showing the hat with the size adjustment feature in the configuration used when the hat is worn.

By referring to FIGS. 2–7, the use of the size adjustment feature 12 of the hat 10 can be more fully appreciated. The area of the sweatband 22 at the rear of the hat is downturned so that the overlapped ends of the sweatband are readily accessible. The hook tape 44 on the flap sweatband end 40 is detached from the loop tape 46 and the end 40 is moved relative to the loop tape 46 on the opposite sweatband end 42 to adjust the size of the sweatband 22 and the amount of overlap of the flap 30 over the fabric panel 34 opposite the slit. FIG. 4 illustrates the hook tape 44 overlapped over substantially all of the loop tape 46 to make the hat smaller in size. FIG. 5 illustrates the hook tape 44 only partially overlapping the loop tape 46 to adjust the hat to a larger size. The downturned portion of the sweatband 22 is folded inwardly in the direction of arrow 48 as shown in FIG. 7 to place the hat in the configuration to be worn. The sweatband 22 including the right the overlapped ends 40 and 42 are thus repositioned at the inside of the crown margin 25 along the inside surface of the crown 16. This process is repeated as necessary until the hat is suitably adjusted to the wearer's head size.

The hat in accordance with the present invention provides a hat which is easily adjustable while also providing an attractive overall appearance. The size adjustment feature 12 can be used to provide a wide range of adjustment without any gap being present at the rear of the hat. Since the flap 38 overlaps the fabric on the opposite size of the slit 30, only an inconspicuous fabric line is visible at the back of the hat and the wearer's head is fully protected from the sun or cold temperatures. The size adjustment feature 12 is also well suited for warm weather hats in accordance with the present invention with the left and right rear fabric panels 34 and 36 are formed from an open mesh with appropriate binding on the mesh adjacent the slit.

While a preferred embodiment has been shown and described in the foregoing detailed description, it will be understood that there is no intent to limit the invention by such disclosure but rather it is intended to encompass all modifications falling with the spirit and scope of the invention as set forth in the appended claims.

What is claimed is:

1. A hat comprising:

a crown providing an opening for receiving the head of a wearer, said crown defining a marginal edge extending along the periphery of said crown opening and including a crown margin adjacent said marginal edge, said crown including means defining a slit extending from said marginal edge and into said crown margin, said crown margin including one portion positioned on one side of the slit and another portion positioned on the opposite side of the slit and forming a flap for overlapping said one portion of said crown margin;

a sweatband having two ends and extending along the marginal edge of the crown so that one end of said sweatband corresponds with said one portion of said crown margin and the other end of said sweatband corresponds with the other portion of said crown margin, said sweatband defining an inside surface and an outside surface and an upper edge and a lower edge extending between the sweatband ends and including one end portion associated with said one end of said sweatband and another end portion associated with said other end of said sweatband, said one end portion of said sweatband being attached to said crown margin by a joining of the lower edge of said one end portion to said crown margin adjacent said marginal edge and for an appreciable distance therealong as measured from said one end of said sweatband and said another end portion of said sweatband being attached to said crown margin adjacent said marginal edge and for an appreciable distance therealong as measured from said another end of said sweatband so that each of said one and another end portions of said sweatband can be selectively moved about the lower edge thereof between a condition of wear within the crown so that the outside surface of said one and another end portions of said sweatband generally faces the inside surface of the crown margin and a generally downturned condition at which the inside surface of the sweatband end portion faces generally outwardly of the crown; and means for attaching said one end portion of said sweatband to said another end portion of said sweatband including press-type fastener means including a first elongate fastener portion attached to so as to extend along the inside surface of said one end portion of said sweatband and a second elongate fastener portion attached to so as to extend along the outside surface of said another end portion of said sweatband, said first and second fastener portions cooperating with one another so that when any part of said first and second fastener portions are positioned in overlapping relationship and operatively pressed together, said first and second fastener portions are releasably secured together in a manner maintaining the positional relationship of said first and second fastener portions relative to one another so that by moving the end portions of said sweatband to said downturned condition, moving said first and second fastener portions relative to and along the length of one another to thereby alter the positional relationship therebetween, operatively pressing the first and second fastener means together to thereby preserve the positional relationship of the first and second fastener means and subsequently repositioning the sweatband end portions to the wear condition, the size of the crown opening is thereby adjusted.

2. The hat of claim 1 wherein said press-type fastener means includes hook and loop fabric tapes.

3. The hat of claim 2 wherein said second fastener portion includes loop tape.

4. The hat of claim 1 wherein said flap is of sufficient size that the size of the opening can be adjusted through a normal range of head sizes with said flap continuing to overlap said one portion of said crown margin.

5. The hat of claim 1 wherein said said flap defines an edge which extends generally downwardly, as said hat is operatively worn, and said another end of said sweatband terminates generally at said flap edge.

6. The hat of claim 5 wherein said one end of said sweatband terminates generally at the edge of said slit.

7. The hat of claim 1 wherein said crown is generally hemispherical in shape and fabricated from interconnected fabric panels and said hat further comprises a downwardly-arched, crescent-shaped visor attached to said crown at the front of said hat.

* * * * *